US006244433B1

(12) United States Patent
Vieu

(10) Patent No.: US 6,244,433 B1
(45) Date of Patent: Jun. 12, 2001

(54) DEVICE FOR STORING THREE COMPONENTS, FOR MIXING THEM, AND FOR DISPENSING THE MIXTURE OBTAINED THEREBY

(75) Inventor: Valérie Vieu, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/495,177

(22) Filed: Feb. 1, 2000

(30) Foreign Application Priority Data

Feb. 10, 1999 (FR) ..... 99 01555

(51) Int. Cl.[7] ..... B65D 25/08; B67D 5/56

(52) U.S. Cl. ..... 206/221; 215/DIG. 8; 222/80; 222/129

(58) Field of Search ..... 206/219, 221, 206/222; 215/6, DIG. 8; 222/80, 83, 129

(56) References Cited

U.S. PATENT DOCUMENTS

| | | | | |
|---|---|---|---|---|
| D. 415,959 | * | 11/1999 | Antoine | D9/347 |
| 3,443,726 | * | 5/1969 | Muller et al. | 222/80 |
| 4,823,946 | * | 4/1989 | Stoeffeler et al. | 203/221 |
| 5,170,888 | * | 12/1992 | Goncalves | 206/222 |
| 5,277,303 | * | 1/1994 | Goyet et al. | 206/221 |
| 5,647,481 | * | 7/1997 | Hundertmark et al. | 206/219 |
| 5,692,644 | * | 12/1997 | Gueret | 222/80 |
| 5,884,759 | * | 3/1999 | Gueret | 206/222 |
| 5,908,107 | * | 6/1999 | Daudin | 206/221 |
| 5,992,693 | * | 11/1999 | Albisetti | 222/129 |

FOREIGN PATENT DOCUMENTS

| | | | |
|---|---|---|---|
| 87 00 341 U1 | * | 6/1988 | (DE) . |
| 198 12 657 A1 | * | 12/1998 | (DE) . |
| 2 763 048 A1 | * | 11/1998 | (FR) . |
| WO 98 51586 A1 | * | 11/1998 | (WO) . |

* cited by examiner

*Primary Examiner*—Bryon P. Gehman
(74) *Attorney, Agent, or Firm*—Oliff & Berridge, PLC

(57) ABSTRACT

A device for separately storing at least three components, for mixing them together, and for extemporaneously dispensing of the resulting mixture includes: a first receptacle containing a first component; a second receptacle containing a second component and provided with a chimney for receiving the neck of the first receptacle; a shutter disposed in removable manner in the chimney; and an intermediate element disposed in the chimney between the shutter and the opening for receiving the neck, with the intermediate element defining a compartment that contains a third component. The neck, the chimney, and the intermediate element are also organized in such a manner that at the end of a predetermined axial displacement stroke of the neck in the chimney, the shutter is ejected, and the components can mix together.

18 Claims, 3 Drawing Sheets

DEVICE FOR STORING THREE COMPONENTS, FOR MIXING THEM, AND FOR DISPENSING THE MIXTURE OBTAINED THEREBY

The present invention relates to devices for separately storing at least three components, for mixing them, and for dispensing them extemporaneously.

BACKGROUND OF THE INVENTION

Such devices are useful in particular for packaging the components of a hair dye.

German utility model 87 00 341 discloses a device having a bottom receptacle and a top receptacle that are capable of turning relative to each other. The bottom receptacle has two coaxial chambers closed on top by a common stopper. The top receptacle has a shoulder which, during rotation of the two receptacles, entrains the above-mentioned stopper away from its closure position, thereby enabling the components to be mixed.

Such a device is relatively complex in structure and is poorly suited to one of the two receptacles being made out of glass, should that be necessary given the nature of one of the components.

In addition, that known device appears to be overdimensioned for the case where one of the three components represents only a small volume of the final mixture, e.g. when said component is a scent or perfume.

Finally, such a device cannot easily be modified for storing four components or even more.

OBJECTS AND SUMMARY OF THE INVENTION

An object of the present invention is a novel device enabling at least three components to be stored separately, to be mixed together, and the resulting mixture to be dispensed extemporaneously, which device should be simultaneously simple to manufacture, reliable, capable of using a receptacle made of glass should that be necessary, and easy to modify where appropriate for separately storing four components, or even more.

The device of the invention comprises:

- a first receptacle having a neck and containing a first component;
- a second receptacle containing a second component and provided with a chimney serving to receive the neck of the first receptacle, at least one of the first and second receptacles including a dispensing endpiece;
- a shutter removably disposed in said chimney to close it prior to use; and
- an intermediate element disposed inside the chimney between said shutter and the opening for receiving the neck, said intermediate element defining at least one compartment containing a third component, the neck, the chimney, and the intermediate element also being organized in such a manner that after a predetermined axial displacement stroke of the neck in the chimney, the shutter is ejected, and the components can mix together.

By means of the invention, the first receptacle can be relatively simple in shape and can be made of glass should that be necessary. Furthermore, the compartment containing the third component can be of a volume that is just sufficient to contain the quantity of substance required, thus making it possible to make a device that is compact.

In a particular embodiment, at the end of said predetermined axial stroke, said cup is ejected.

Still in a particular embodiment, the device includes an annular sealing lip inside the chimney, the sealing lip being suitable for bearing in sealed manner against the neck at least at the end of the axial displacement thereof inside the chimney, said lip being situated between said intermediate elements and the opening of the chimney serving to receive the neck.

Preferably, said lip is directed towards the inside of the second receptacle, and said intermediate element initially bears against said lip.

In a particular embodiment of the invention, the intermediate element is constituted by a cup.

Preferably, the cup initially bears via a rim at its periphery against an inside shoulder of the chimney.

Advantageously, the shutter has a ring shaped initially to engage in sealed manner on the chimney and initially resting via its bottom face on the said rim.

Preferably, the ring defines a downwardly open groove for capping the free end of the chimney.

In a particular embodiment, the intermediate element has at least one bearing surface in its center against which the shutter bears initially.

The bearing surface can be constituted by a central peg, or in a variant by one or more partitions co-operating with the shutter to define compartments that are to contain the respective components separately.

It is thus easy to store four or more components merely by modifying the cup, by adding partitions so as to make additional compartments.

Preferably, the neck and the chimney are suitable for screw co-operation.

In a particular embodiment, the second receptacle has a body provided at its bottom with a tubular skirt, and the chimney is carried by a connection piece fixed to said body.

BRIEF DESCRIPTION OF THE DRAWINGS

The invention will be better understood on reading the following detailed description of a non-limiting embodiment, and on examining the accompanying drawings, in which.

MORE DETAILED DESCRIPTION

Figure 1:
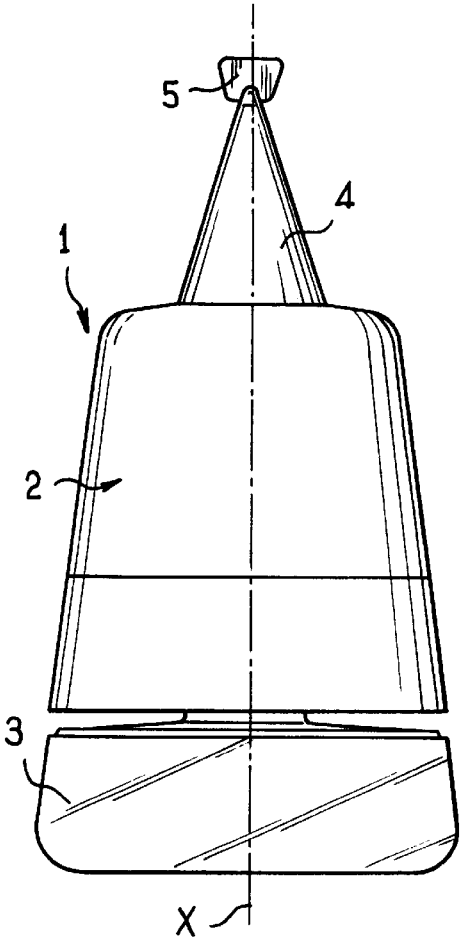
FIG. 1 is an elevation view of a device constituting an embodiment of the invention, the neck of the bottom receptacle being engaged in the chimney of the top receptacle.

The device 1 shown in FIG. 1 comprises a top receptacle 2 and a bottom receptacle 3 enabling two respective components A and B to be stored separately and to be mixed together at the moment of use.

In the embodiment described, the top receptacle 2 contains a liquid oxidizer and the bottom receptacle 3 contains a liquid dye, and the resulting mixture is intended for dyeing the hair.

Figure 2:
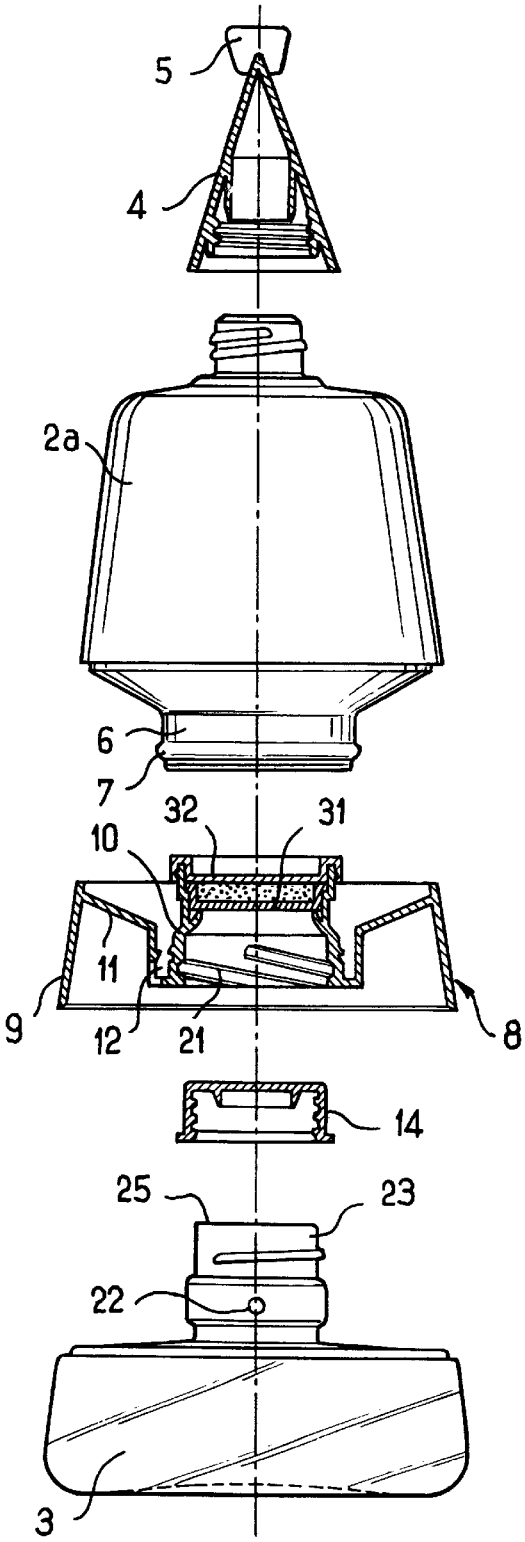
FIG. 2 is an exploded view of the FIG. 1 device.

As can be seen in FIG. 2, the body 2*a* of the top receptacle 2, made of plastics material, is provided at its top end with an endpiece 4 in turn provided with a snap-off end 5 and including at its base a tubular skirt 6 about an axis X, provided on its outside with an annular bead 7 enabling a connection piece 8 to be fixed thereto.

Figure 3:
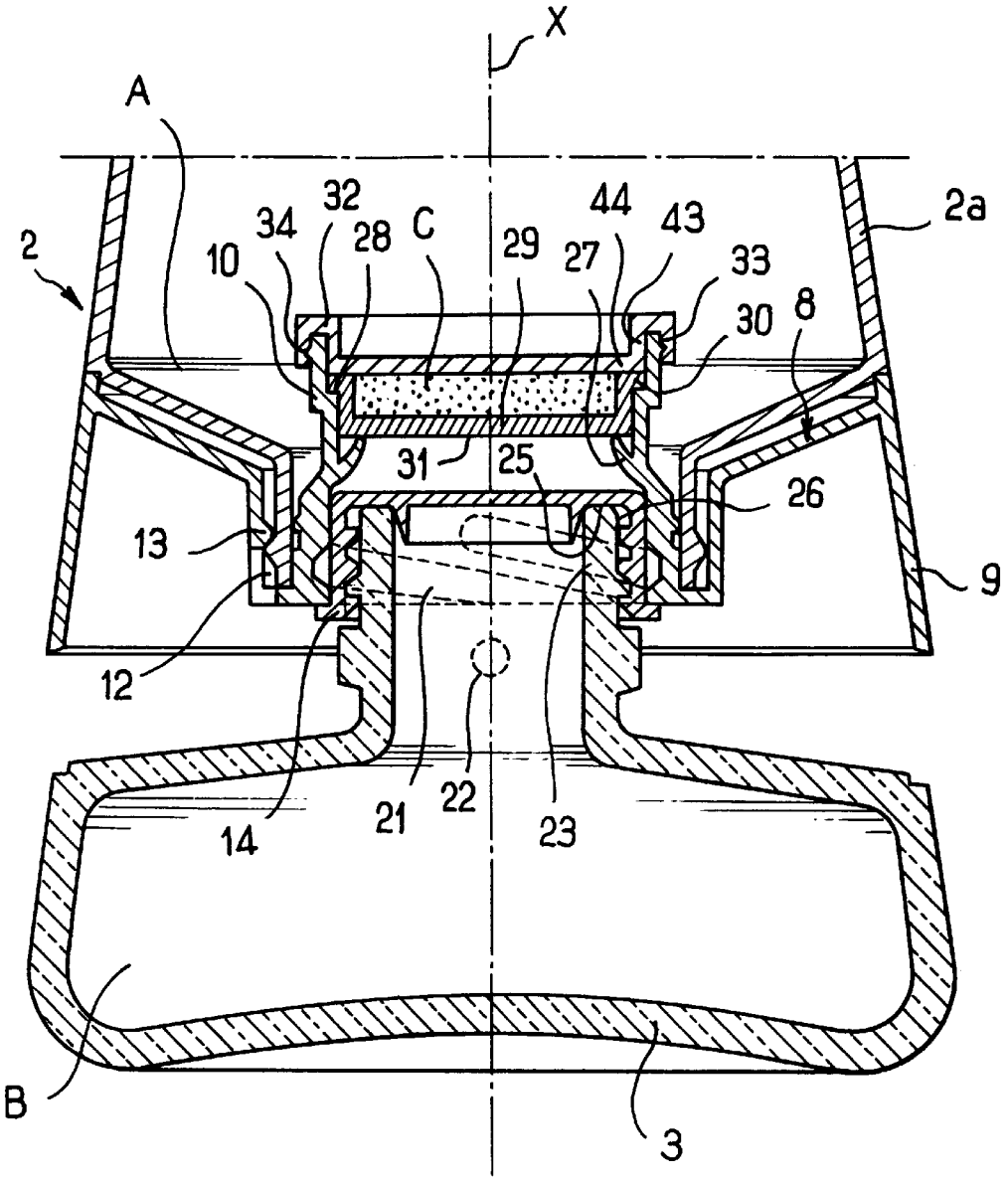
FIG. 3 is a fragmentary diagrammatic view in axial section of the bottom portion of the FIG. 1 device, prior to use.

The connection piece has an outer skirt 9 that takes up a position in line with the outside wall of the body of the receptacle 2, and an inner chimney 10 extending inside the body 2*a*, as can be seen in FIG. 3.

The skirt 9 and the chimney 10 are connected together by a wall 11 defining an annular groove 12 that is upwardly open and that is designed to receive the skirt 6 of the receptacle 2.

The groove 12 is provided with engagement relief 13 for co-operating with the annular bead 7 so as to fix the connection piece 8 to the receptacle 2, with the skirt 6 being a leakproof fit therein.

The bottom receptacle 3 has a threaded neck 23 onto which there is screwed a stopper 14 that is designed to be removed at the time of use.

At its base and on its inside surface, the chimney 10 has helical grooves 21 and the receptacle 3 has studs 22 designed to co-operate with the helical grooves 21, so that rotating the bottom receptacle 3 relative to the top receptacle 2 in a determined direction causes the neck 23 to move upwards along the axis X.

The neck 23 has no thread over a certain distance starting from its top end 25, thus presenting a circularly cylindrical surface 26 around the axis X, as can be seen in FIG. 3.

An upwardly directed annular sealing lip 27 projects into the chimney 10 so as to bear in sealed manner against said cylindrical surface when the top and bottom receptacles 2 and 3 enter into communication, as described below.

A cup 29 having its concave side directed towards the inside of the top receptacle 2 is engaged in the chimney 10, and the top of the chimney includes an inside shoulder 28 on which the cup 29 rests via a peripheral rim 30.

In the embodiment described, the cup 29 bears firstly via its bottom face 31 on the free end of the sealing lip 27 and fits secondly in sealed manner via its side wall against the inside of the chimney 10.

The cup 29 is filled with a third component C, e.g. a perfume in liquid or powder form, the component C being unsuitable for being stored while mixed with either of the components A or B since it then deteriorates over time.

A shutter 32 is fixed in removable manner on the free end of the chimney 10 and co-operates with the cup 29 to define an intermediate compartment containing the component C.

The shutter 32 bears via its bottom face on the rim 30 of the cup 29 and has a annular portion 33 at its periphery to define a downwardly-directed groove 45 which engages in sealed manner on the chimney 10 and which is shaped so as to snap-fasten onto an outer bead 34 thereof.

The connection piece 8 is fixed to the body 2*a* while the cup 29 and the shutter 32 are already in place.

To use the device 1, the user begins by unscrewing the stopper 14 and then engages the neck 23 in the chimney 10.

Figure 4:
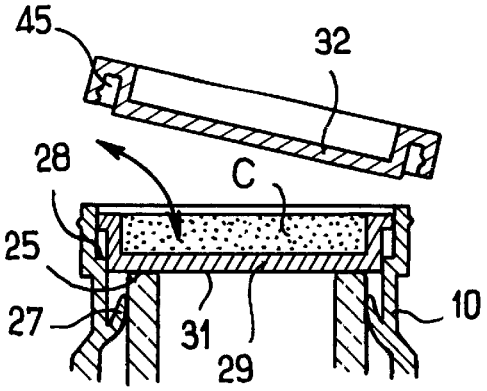
FIG. 4 shows the immediate compartment being put into communication with the top receptacle.

After the bottom receptacle 3 has been rotated a certain amount, the top end 25 of the neck 23 reaches the lip 27 and then bears against the bottom face 31 of the cup 29 so that the cup is then entrained along the axis X towards the inside of the receptacle 2, i.e. upwards in FIG. 4.

Continued displacement of the neck 23 causes the shutter 32 to be ejected, thereby allowing the components A and C to mix together.

Figure 5:
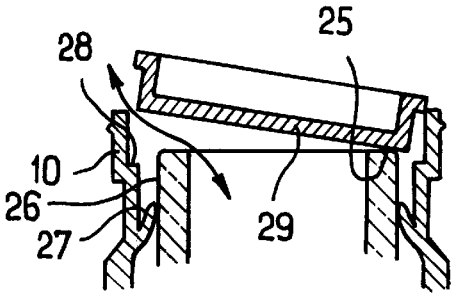
FIG. 5 shows the top and bottom receptacles being put into communication with each other.

Thereafter, the cup 29 is pushed beyond the shoulder 28. The inside diameter of the chimney 10 above the shoulder 28 is greater than the outside diameter of the side wall of the cup 29, so the cup 29 ceases to close the chimney 10, thereby enabling the components A and B to be mixed together, as shown in FIG. 5.

It will be observed that the lip 27 bears in sealed manner against the cylindrical surface 26 of the neck 23.

Figure 6:
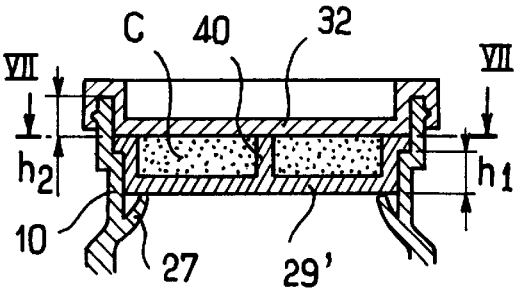
FIGS. 6 to 9 show to variant embodiments of the intermediate compartment.

FIG. 6 shows a variant embodiment in which the cup 29 is replaced by a cup 29' having a bearing surface 40 in its center, against which the bottom face of the shutter 32 bears initially.

Figure 7:
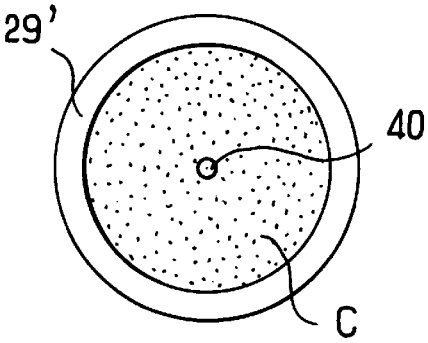

The bearing surface 40 is constituted by a central peg, as can be seen in FIG. 7.

Thus, the shutter 32, and the cup 29' in this case have a larger area of contact than in the embodiment described above, thereby improving the distribution of forces for the purpose of ejecting the shutter 32.

Figure 8:
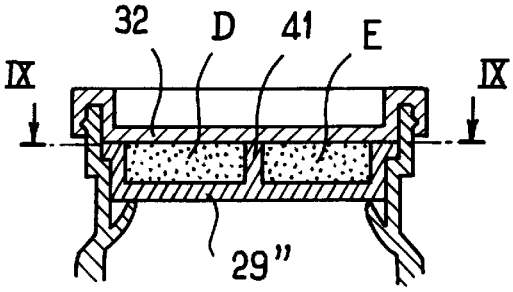

The variant of FIG. 8 differs from the preceding variants by the fact that the cup 29 is replaced by a cup 29" which is subdivided into two compartments by means of a diametral partition 41, thus making it possible to store two components D and E instead of the component C.

Like the peg 40, the partition 41 serves to provide a better distribution of forces for the purpose of ejecting the shutter 32.

In the three embodiments described above, the height $h_1$ of the surfaces of the cup and of the chimney which come into contact is slightly greater than the height $h_2$ of the surfaces of the shutter and of the chimney which come into contact, as can be seen in FIG. 6, such that during axial displacement of the neck 23 in the chimney 10, the shutter 32 is ejected while the cup 29 still closes the chimney, as shown in FIG. 4.

The components A and C can thus be mixed together in a first step without the presence of component B, since it remains contained in the bottom receptacle 3.

Figure 9:
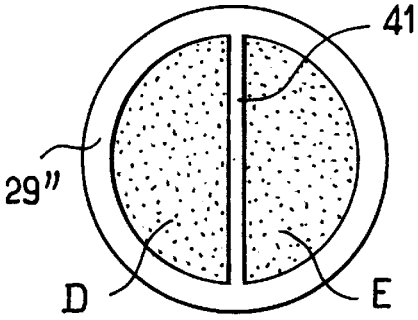

Naturally, it would not go beyond the ambit of the present invention to reduce the height $h_1$ so that it becomes less than or equal to the height $h_2$, whereby the shutter 32 and the cup are ejected simultaneously, with all three components A, B, and C or four components A, B, D, and E mixing together in the context of the embodiment of FIGS. 8 and 9, in this case in a single step instead of in two steps as described above.

In the embodiments described, the bottom receptacle 3 is constituted by a glass flask, but in a variant it could naturally be made of plastics material.

In the embodiments described, the cup is ejected. In a variant, the cup could be made with passages so as to allow the components contained in the top and bottom compartments to mix together without the cup needing to be ejected.

In the embodiments described, the component(s) contained in the cup is/are prevented by the shutter from leaving the cup prior to use. In a variant, the cup may have fitted thereto a membrane that is made out of a material that is soluble in the component contained in the top compartment, with the component(s) then being prevented from leaving the cup by said membrane and not by the shutter.

What is claimed is:

1. A device for separately storing at least three components, for mixing them together, and for extemporaneously dispensing the resulting mixture, the device comprising:

a first receptacle having a neck and containing a first component;

a second receptacle containing a second component and provided with a chimney having an opening serving to receive the neck of the first receptacle, with a possibility for the neck to be displaced in the chimney be a predetermined axial displacement stroke, at least one of the first and second receptacles including a dispensing endpiece;

a shutter removably disposed in said chimney to close it prior to use; and an intermediate element disposed inside the chimney between said shutter and the opening for receiving the neck, said intermediate element defining at least one compartment containing a third component, the neck, the chimney, and the intermediate element also being organized in such a manner that after said predetermined axial displacement stroke of the neck in the chimney, the shutter is ejected, and the components can mix together.

2. A device according to claim 1, wherein, at the end of said predetermined axial stroke, said intermediate element is ejected.

3. A device according to claim 1, including an annular sealing lip inside the chimney, the sealing lip being suitable for bearing in sealed manner against the neck at least at the end of the axial displacement thereof inside the chimney, said lip being situated between said intermediate element and the opening of the chimney serving to receive the neck.

4. A device according to claim 3, wherein said lip is directed towards the inside of the second receptacle, and wherein said intermediate element initially bears against said lip.

5. A device according to claim 1, wherein the intermediate element is constituted by a cup.

6. A device according to claim 5, wherein the cup initially bears via a rim at its periphery against an inside shoulder of the chimney.

7. A device according to claim 6, wherein the shutter has an annular portion shaped initially to engage in sealed manner on the chimney and initially resting via its bottom face on the peripheral rim of the cup.

8. A device according to claim 7, wherein said annular portion defines a downwardly-open groove and wherein said chimney is initially engaged in said groove.

9. A device according to claim 1, wherein the intermediate element has at least one bearing surface in its center against which the shutter bears initially.

10. A device according to claim 9, wherein said at least one bearing surface is constituted by a central peg.

11. A device according to claim 9, wherein said at least one bearing surface is constituted by at least one partition suitable for co-operating with the shutter to define compartments for containing respective components to be stored separately.

12. A device according to claim 1, wherein the height of the surfaces of the intermediate element and of the chimney which are in contact when the intermediate element is in its initial position is equal to the height of the surfaces of the shutter and of the chimney which are in contact when the shutter is in its initial position.

13. A device according to claim 1, wherein the height of the surfaces of the intermediate element and of the chimney which are in contact when the intermediate element is in its initial position is greater than the height of the surfaces of the shutter and of the chimney which are in contact when the shutter is in its initial position.

14. A device according to claim 1, wherein the neck and the chimney are suitable for screw co-operation.

15. A device according to claim 1, wherein the neck has a thread for receiving a closure stopper.

16. A device according to claim 1, wherein the first receptacle is made of glass.

17. A device according to claim 1, wherein the second receptacle has a body provided at its bottom with a tubular skirt, and wherein the chimney is carried by a connection piece fixed to said body.

18. A device according to claim 1, wherein the components when mixed, constitute a hair dye, the first receptacle containing a dye, the second receptacle containing an oxidizer, and the third component being constituted by a perfume.

* * * * *